United States Patent [19]

Masar et al.

[11] 3,998,716

[45] Dec. 21, 1976

[54] METHOD OF APPLYING COATINGS

[75] Inventors: Edward J. Masar, Sylvania; John B. Boucher, Bowling Green; Ralph A. Williams, Swanton, all of Ohio

[73] Assignee: Inmont Corporation, New York, N.Y.

[22] Filed: June 3, 1974

[21] Appl. No.: 475,854

[52] U.S. Cl. ..... 204/181; 427/13; 427/27

[51] Int. Cl.[2] ..... C25D 13/04; C25D 13/06; C25D 13/20

[58] Field of Search ..... 204/181; 117/17, 29, 117/33; 427/13, 27, 25

[56] References Cited

UNITED STATES PATENTS

| | | | |
|---|---|---|---|
| 3,290,235 | 12/1966 | Gilchrist | 204/181 |
| 3,326,848 | 6/1967 | Clemen et al. | 252/62.1 |
| 3,340,172 | 9/1967 | Huggard | 204/181 |
| 3,499,852 | 3/1970 | Schroeder et al. | 260/859 R |
| 3,532,613 | 10/1970 | Gilchrist | 204/181 |
| 3,541,274 | 11/1970 | D'Cruz | 260/33.8 UB |
| 3,575,909 | 4/1971 | Gilchrist | 204/181 |
| 3,658,763 | 4/1972 | Dehm | 260/33.8 UB |
| 3,663,383 | 5/1972 | Matsuda et al. | 204/181 |
| 3,819,586 | 6/1974 | Rudolph et al. | 260/77.5 TB |
| 3,822,240 | 7/1974 | Schmitt et al. | 260/77.5 TB |

*Primary Examiner*—T. M. Tufariello

[57] ABSTRACT

Thermosetting coatings comprising multiple coats of thermosetting organic coating material, including a top coat of powder paint, are cured by employing a single baking step.

10 Claims, No Drawings

METHOD OF APPLYING COATINGS

This invention relates to a process for applying protective and decorative coatings or finishes to metal surfaces, including automobile and truck bodies.

The conventional method of painting steel automobile and truck bodies using powder paint as the topcoat comprises the following steps:

1. The steel surface is degreased and passivated by either iron phosphate treatment or zinc phosphate treatment.
2. The phosphated steel surface is primed by either (a) a primer-surfacer baked for about 45 minutes at 325° F., or (b) an electrodeposition primer baked about 30 minutes at 350° F.
3. The baked primer coating (sanded in the case of the primer-surfacer coating) is overcoated with a conductive-sealer coat, usually with a sealer pigmented with a conductive carbon black pigment, and the sealer coat is baked for about 30 minutes at 300° F. and
4. the conductive sealer coat is then coated with a topcoat of electrostatically sprayed powdered paint and then fused to a continuous film by heating for 20–30 minutes at 350° F.

In such a process the three baking steps at 300° F or above are undesirable from the standpoint of time, space, and more especially, the large consumption of heating fuel, which is becoming short in supply.

The present invention has as its major goal the provision of an improved process of applying protective and decorative finishes to steel automobile and truck bodies, wherein powder paint is used as the topcoat. A main improvement provided by the invention is the elimination of at least one of the baking steps requires in conventional prior art process. The present invention provides the further improvement of eliminating, in most instances, the need for the application of an additional or special conductive sealer coat prior to applying the powder paint by electrostatic spraying. Other advantages provided by the invention will become obvious from the detailed description of the invention which follows:

In accordance with the invention a method of applying protective and decorative finishes to steel automobile and truck bodies is provided wherein a powder paint is used as the topcoat and the only baking step is after the powder paint topcoat has been applied. The improved process is made possible by the discovery that it is unnecessary to bake the primer coat before applying the topcoat and, also, that when the primer coat is not baked it can serve as the conductive surface for the application of the powder paint topcoat by the electrostatic powder spraying process. Thus, by eliminating the sealer coating step and two baking steps the invention provides a much improved process for applying protective and decorative finishes to steel automobile and truck bodies. Even in cases where it is desirable to include a conductive sealer coat in the coating system, it is not necessary to bake the sealer coats before applying the powder topcoat; i.e. the composite coating consisting of primer, sealer and topcoat can be cured in a single baking step.

The essential steps in the process of the invention are:

1. Electrodeposit a primer coat onto a conventionally phosphated steel surface, 2. rinse the wet primer coat in conventional manner,
3. dry the rinsed primer coats for 5 minutes at 200° F., to evaporate residual surface water without curing the primer film,
4. electrostatically spraying a powder paint onto the uncured primer coating and
5. bake the coating at 325° F. for 20–30 minutes to simultaneously cure the topcoat and primer.

Surprisingly, the process of the invention results in a finish having an improved visual appearance compared with finishes produced by conventional prior art procedures in which the primer, sealer and topcoats are separately baked. Adhesion to the steel surface and adhesion between the fused powder paint film and the primer coat are both excellent.

In the above general description of the steps of the novel process, it is to be understood that, when temperatures and times for dyring or curing are given, these conditions can be changed to other equivalent conditions of time and temperature. For instance, the primer coat can be dried at temperatures higher than 200° F. (but below curing temperature) for a shorter period of time, or it can be dried at a lower temperature for a longer period of time.

An important feature of the invention is the powder paint used as the topcoat. For best results a thermosetting powder comprised of pigmented cross-linkable acrylic polymer is used. The cross-linkable acrylic polymer may be of the self cross-linking type or it may be one that requires a cross-linking agent. A blocked polyisocyanate cross-linking agent is preferred. Some powders that are preferred for use in the invention are disclosed in copending application Ser. No. 475,414, filed June 3, 1974, and the disclosure of said application is incorporated herein by reference. In accordance with said copending application powder paints suitable for application by electrostatic spray gun to conductive surfaces comprise pigmented mixtures of certain cross-linkable acrylic polymers with certain blocked polyisocyanates. The cross-linkable acrylic polymer is a copolymer containing 3 to 25% by weight, based on total monomers, of an active hydrogen containing monoethylenically unsaturated compound of the formula $$CH_2{=}\overset{\overset{\displaystyle R}{|}}{C}{-}COOR^1OH$$

where R is hydrogen or methyl and $R^1$ is an alkylene group containing 2 to 4 carbon atoms and 45 to 97% by weight, based on total monomers, of at least one lower alkyl ester of methacrylic acids wherein the lower alkyl group contains 1 to 12 carbon atoms. The acrylic copolymer may contain other copolymerized monomers such as styrene or substituted styrenes, e.g., vinyl toluene or $\alpha$-methyl styrene, in amounts not exceeding about 30% by weight based on total monomers. Further, the acrylic copolymer may contain up to about 30% by weight, based on total monomers, of one or more alkyl esters of acrylic acid wherein the alkyl group contains 1 to 12 carbons. These acrylic resins, especially those having a glass transition temperature in the range of 45° to 95° C., when formulated with the desired pigment and cross-linker, produce excellent finishes having good gloss and durability. Resins having glass transition temperatures outside this range tend to produce finishes having inferior gloss, poor solvent resistance in some cases, and package stability is on the low side. In general the cross-linkable acrylic polymer should preferably have a weight average molecular weight in the range of 10,000 to 90,000. Self cross-linking acrylic polymers that are operable in the invention are, for example, those containing N-alkoxymethyl acrylamide units, preferably with minor amounts of hydroxyalkyl acrylate or methacrylate monomer.

Blocked polyisocyanates that are useful in the powder paint can be any conventional blocked polyisocyanate as known in the prior art provided that the isocyanate groups are substantially completely inactivated during preparation, storage and spraying of the powder but liberates the isocyanate groups at temperatures of 310° F. and above, or at temperatures at which the coating is to be cured. For best properties in the final cured, or thermoset, coatings prepared from the powders, the non-aromatic type polyisocyanates are preferred. Isophorone diisocyanate and hydrogenated methylene diphenyl isocyanate are especially preferred because of their basically good outdoor weathering characteristics, good hardness, and excellent reactivity when used as cross-linking agents. Other basically durable isocyanates such as 2, 6 diisocyanate methyl caproate are not desirable because of lack of adequate hardness that they impart to the film.

Of the numerous blocking agents tested caprolactam is the best and therefore is the preferred blocking agent. Other conventional blocking agents, such as ketoximes, are less desirable because they have a tendency, when used alone as the blocking agent, to produce pinholing in the cured coatings. Other cross-linking agents that are operable in the invention include dicarboxylic acids, e.g., adipic acid, and aminoplast resins, e.g., melamine-formaldehyde resins.

Pigments that are operable in the powder paints include inorganic and organic pigments conventionally used in automotive finishes, as well as metallic pigments. The amount of pigment employed will depened upon the depth of color desired and the tinctorial strength of the particular pigments used in the paint. The ratio of pigment to binder will generally be similar to that used in conventional automotive paints and may be from 1 to 50% by weight of the powder.

Electrodeposition of primers onto phosphate treated steel automobile and truck bodies is a well established practice in the automotive industry. For a more detailed description of the process and the composition of the primers used, reference may be had to numerous patents such as Gilchrist U.S. Pat. Nos. 3,230,162 and 3,362,889 and Hart, et al., 3,366,563. In general electrodeposition primers are applied by immersing the metal substrate in a pigmented or clear coating bath comprised of an aqueous solution of a water-soluble salt of resinous, or polymeric material containing carboxyl groups, and direct current at 50 to 600 volts is passed through the bath using the metal substrate, e.g., the automobile or truck body, as the anode, to deposit a coating of the carboxylic polymer on the substrate. The coated substrate is removed from the bath, rinsed with water, and baked at 150° to 300° C. to cure the electrodeposited primer coat. In accordance with the present invention, the curing of the electrodeposited primer coating is not required before applying the topcoat. In some cases, a baking sealer is used to obtain better adhesion of the topcoat and better electrostatic attraction of the topcoat powder; when such sealers are used a separate baking step for the sealer can be omitted and the composite coating can be cured in one curing step after the powder topcoat is applied. Thus, two baking steps are eliminated. The following examples in which the parts are by weight are given to further illustrate the invention.

EXAMPLE 1

A sheet of phosphated steel is coated with electrodeposition primer using a bath comprised of a carbon black dispersed in an aqueous alkaline solution (potassium hydroxide, pH8 to 8.5) of the heat reaction product (145° C. for 1 hour) of 1149 parts of linseed fatty acid ester of Epon 1004 (condensate of Bisphenol A and epichlorohydrin, epoxy equivalent 875-1025) with 1532 parts of maleinized tall oil fatty acid (1140 parts tall oil fatty acid and 392 parts maleic anhydride) by immersing the panel in the bath and passing a direct current through the bath at a potential of 200 to 250 volts for 1 minute. The panel, containing the electrodeposited film of primer is removed from the bath, rinsed with water, and dried for about 5 minutes at 200° F. to evaporate the surface water without curing the primer film. The uncured primer film, at this point, is electrically conductive. A powdered paint, produced by Example 1 of application Ser. No. 475,414 is electrostatically sprayed onto the uncured primer to form a continuous topcoat having a thickness of 2 to 3 mils when cured, and then the composite of primer and topcoat is cured by heating for 20 to 30 minutes at 350° F. The resulting thermoset finish is excellent in appearance and the flow-out of the powder paint is visibly enhanced compared to the appearance of a similar finish wherein the same powder paint is applied by the conventional process, i.e., onto a cured sealer coat which has been applied over a cured electrodeposition primer coat. Similarly, the appearance and properties of the finish applied in accordance with the Example is far superior to finishes produced by using powder paints disclosed in the prior art. For example, the gloss obtained by applying a powder paint topcoat to a highly pigmented primer coat by the process of the invention is much superior to the gloss obtained by prior art processes for applying topcoats to highly pigmented primer coats. Also, the adhesion of the topcoat to pigmented or unpigmented primer coats is superior to that of prior art finishes. Further, the process of the invention has the added advantage of eliminating one high temperature bake in the process of finishing an automobile with the resulting saving of energy requirements.

EXAMPLE 2

A sheet of phosphated steel is coated with electrodeposition primer using a bath as in Example 1 except that the solubilizing agent is dimethylaminoethanol and a direct current is passed through the bath at a potential of 300 to 450 volts for one minute. The panel, containing the electrodeposited film of primer is removed from the bath, rinsed with water, and dried for about 5 minutes at 200° F. to evaporate the surface water without curing the primer film. The uncured primer film, at this point, is electrically conductive. A powdered paint, produced by Example 1 of application Ser. No. 475,414, is electrostatically sprayed onto the uncured primer to form a continuous top-coat having a thickness of 2 to 3 mils when cured, and then the composite of primer and topcoat is cured by heating for 20 to 30 minutes at 325° F. The resulting thermoset finish has properties similar to the properties of the finish of Example 1.

EXAMPLE 3

Example 1 was repeated except that the resin in the primer bath is a maleinized tall oil fatty acid ester of a resinous polyol (styrene-allyl alcohol copolymer, mol. weight 1500 and 5.7% hydroxyl content) made from 46 parts of the polyol, 48.6 parts tall oil fatty acid and 5.4% maleic anhydride, and the primer is applied at a voltage of 250 to 450 volts and is dried by baking at 250° F. for 2 minutes. The resulting finish was similar to that of Example 1.

EXAMPLE 4

Example 1 was repeated except that the electrodeposited primer coat was dried by baking at 160° F. for 30 minutes. The resulting finish was similar to that of Example 1.

EXAMPLE 5

Example 1 was repeated except that the powder paint used contained melamine-formaldehyde resin, instead of blocked polyisocyanate, as the cross-linking agent for the hydroxyl group containing acrylic polymer. The primer and powder paint topcoat were cured in the same baking cycle at 350° F. for 20 minutes. The resulting finish had properties similar to the finish obtained in Example 1.

EXAMPLE 6

Example 1 was repeated except that the powder paint containing a copolymer of glycidyl methacrylate as the cross-linkable acrylic polymer and adipic acid as the cross-linking agent. The primer and powder paint topcoat were cured in the same baking cycle at 360° F. for 20 minutes. The resulting finish had properties similar to the finish obtained in Example 1 except that the panel was not as smooth because the powder was not attracted electrostatically as well as the powder in Example 1.

The powders used in Example 5 and 6 have poorer stability characteristics than the powders used in the previous Examples and are therefore less preferred. The powders used in Examples 5 and 6 tend to sinter at room temperature and therefore need to be stored under refrigeration.

EXAMPLE 7

Example 1 is repeated except that the cross-linkable polymer of the powdered paint topcoat consisted of an acrylic copolymer from 40% methyl methacrylate, 38% butyl methacrylate, 12% N-isobutoxymethyl acrylamide, and 10% hydroxyethyl methacrylate prepared in solution in methylene chloride in a pressure vessel using 2.5% based on monomer charge, of 2,2'azobis (2,4-dimethyl-valeronitrile) as catalyst, and polymerized to a viscosity of 550 centipoises at 25° C. at 43% solids. This copolymer is self-cross-linking at 325° F. for 30 minutes using 0.10 parts of p-toluene sulfonic acid catalyst per 100 parts of copolymer. The coating obtained by curing the primer and powder topcoat simultaneously by baking 20–30 minutes at 350° F. has properties similar to those of Example 1.

What is claimed is:

1. A method of applying protective and decorative finishes to metal surfaces comprising a. electrodepositing a primer coat on the phosphate treated metal surface, b. rinsing the primer coated surface with water, c. drying the rinsed primer coat for about 5 minutes at 200° F. to evaporate residual surface water without curing the primer film, d. electrostatically spraying powder paint onto the uncured primer coating to form a topcoat thereon and e. baking the coated surface at 325° F. for 20–30 minutes to cure the uncured primer coat and the uncured powder paint.

2. A method as in claim 1 which includes the additional step of applying a sealer coat after drying the primer coat and before applying the powder paint topcoat.

3. A method as in claim 1 where the powder paint is comprised of a mixture of (A) an acrylic polymer and (B) a blocked polyisocyanate, said acrylic polymer being a copolymer of a mixture of (a) 0 to 30% by weight, of a monomer of the group consisting of styrene, α-methyl styrene and vinyl toluene, (b) 3 to 25% by weight of an active hydrogen containing monoethylenically unsaturated compound of the formula

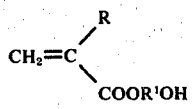

where R is hydrogen or methyl and $R^1$ is an alkylene radical containing 2 to 4 carbon atoms, (c) 45 to 97% by weight of a lower alkyl ester of methacrylic acid and (d) 0 to 30% by weight of a lower alkyl ester of acrylic acid, said acrylic resin being further characterized as having a glass transition temperature between 45° C. and 60° C., and wherein the ratio of (A) and (B) is substantially 1:1 on the basis of equivalents of hydroxyl groups in (A) to isocyanate groups in (B).

4. A method as in claim 3 wherein the powder paint contains 1 to 50% by weight of pigment.

5. A method as in claim 3 wherein the polyisocyanate is blocked with caprolactam.

6. A method as in claim 3 wherein the polyisocyanate is isophorone diisocyanate.

7. A method as in claim 3 wherein the acrylic polymer is a mixture of two acrylic copolymers consisting of (1) a copolymer of 30% by weight methyl methacrylate, 30% by weight isobutyl methacrylate, 25% by weight butyl methacrylate and 15% by weight hydroxyethyl methacrylate and (2) a copolymer of 30% by weight styrene, 30% by weigh isobutyl methacrylate, 25% by weight butyl methacrylate and 15% by weight hydroxyethyl methacrylate.

8. A method as in claim 1 wherein the powder paint is comprised of a self-cross-linking acrylic polymer.

9. A method as in claim 8 wherein the acrylic polymer is a copolymer 40 parts methyl methacrylate, 38 parts butyl methacrylate, 12 parts N-isobutoxymethyl acrylamide, and 10 parts hydroxyethyl methacrylate.

10. A method as in claim 1 wherein the powder paint is comprised of a mixture of (A) a cross-linkable acrylic polymer and (B) a cross-linking agent of the group consisting of (1) blocked polyisocyanate, (2) dicarboxylic acids, and (3) aminoplast resins.

* * * * *